US005247420A

United States Patent [19]

Bakhoum

[11] Patent Number: 5,247,420

[45] Date of Patent: Sep. 21, 1993

[54] GROUND-FREE STATIC CHARGE INDICATOR/DISCHARGER

[76] Inventor: Ezzat G. Bakhoum, 613 Clarion Dr., Durham, N.C. 27705

[21] Appl. No.: 945,299

[22] Filed: Sep. 15, 1992

Related U.S. Application Data

[63] Continuation-in-part of Ser. No. 870,060, Apr. 17, 1992, abandoned, which is a continuation-in-part of Ser. No. 828,155, Jan. 30, 1992, abandoned, which is a continuation-in-part of Ser. No. 707,691, May 30, 1991, Pat. No. 5,179,947, which is a continuation-in-part of Ser. No. 691,350, Apr. 25, 1991, abandoned.

[51] Int. Cl.[5] ..... H05F 3/00

[52] U.S. Cl. ..... 361/212; 361/220

[58] Field of Search ..... 361/212, 220, 217, 218; 307/9.1, 10.1

[56] References Cited

U.S. PATENT DOCUMENTS

| | | | |
|---|---|---|---|
| 3,634,726 | 1/1972 | Jay . | |
| 4,333,124 | 6/1982 | Tamura et al. . | |
| 4,523,252 | 6/1985 | Wallén . | |
| 4,729,057 | 3/1988 | Halleck | 361/213 |
| 4,766,903 | 8/1988 | Esper . | |
| 4,849,851 | 7/1989 | Cubbison, Jr. . | |
| 4,862,315 | 8/1989 | Cubbison, Jr. . | |
| 5,000,425 | 4/1991 | Hee | 361/220 |
| 5,164,674 | 11/1992 | Bakhoum | 361/212 |
| 5,179,497 | 1/1993 | Bakhoum | 361/212 |

OTHER PUBLICATIONS

Author: H. W. Cleveland, Title: Static Discharging Characteristics of a jet Ion Generator, Date: 1967, International Conf. on Static Electrification, pp. 139–145.

Author: B. R. Whewell et al., Title: A Study of Charged Condensation Droplets from an Aircraft Discharger., Date: 1971, International Conf. on Static Electr., pp. 270–281.

Pulse, Digital and Switching Waveforms, a book by Millman and Taub, published by McGraw Hill, 1984, pp. 605–606.

*Primary Examiner*—Jeffrey A. Gaffin

[57] ABSTRACT

A ground-free device for the measurement and/or the removal of static charges from a conductive or semiconductive body, and particularly useful for the human body and transportation vehicles, such as cars and aircrafts. The device is based on the fundamental concept that a discharge terminal equipped with a capacitor will acquire a voltage proportional to the amount of charge on the body. This concept is used in the present invention to activate a mechanism for the removal of static charges. The mechanism comprises a Voltage-Controlled Oscillator (VCO) that senses voltage on the discharge capacitor and generates high voltage pulses of a frequency that is proportional to the amount of charge on the body. High voltage, in turn, effects the removal of charges by means of air ionization.

33 Claims, 7 Drawing Sheets

GROUND-FREE STATIC CHARGE INDICATOR/DISCHARGER

CROSS-REFERENCE TO RELATED APPLICATION

This is a continuation-in-part of U.S. application Ser. No. 07/870,060 filed Apr. 17, 1992 in the name of Ezzat G. Bakhoum for "A Ground-free Static Charge Removal Device" (now abandoned) which is a continuation-in-part of U.S. application Ser. No. 07/828,155 filed Jan. 30, 1992 in the name of Ezzat G. Bakhoum for "A Ground-free Static Charge Removal Device" (now abandoned) which is a continuation-in-part of U.S. application Ser. No. 07/707,691 filed May 30, 1991 in the name of Ezzat G. Bakhoum for "A Ground-free Static Charge Removal Device" (now U.S. Pat. No. 5,179,497); issued Jan. 12, 1993, which is a continuation-in-part of U.S. application Ser. No. 07/691,350 filed Apr. 25, 1991 in the name of Ezzat G. Bakhoum for "Corporeal Static Charge Removal Device" (now abandoned).

Background of the invention

1. Field of the invention

This invention relates to a ground-free device for the measurement/removal of static electrical charge from a conductive or semi-conductive body, and particularly a device of such type which may be mounted on the human body and on transportation vehicles.

2. Description of the related art

While the present invention is broadly useful for removing static electrical charge from conductive and semi-conductive charged bodies, the applications of particular concern are the discharge of static electricity from transportation vehicles (cars and aircrafts) and from the human body.

It is known that static electricity build-up during the movement of ground transportation vehicles is responsible for pains, fatigue, and drowsiness of passengers, as well as damage of electronic equipment in the vehicle. Recent medical studies showed that drowsiness is a result of strong stimulation of the nervous system, which, among other effects such as fatigue, occur to individuals who become exposed to high electrostatic fields. In the case of aircrafts, static build-up results in abrubt discharges from sharp points on the body of the aircraft which generate RF (Radio Frequency) noise and interfere with the navigation systems of the aircraft. Static build-up on helicopters is further undesirable, as a hovering helicopter can reach a potential of 200 KV with a stored energy of more than 30 joules, which constitutes a serious hazard to ground personnel during winching and rescue operations.

Historically, chains and conductive rods, attached to the bodies of these vehicles, have been used to drain static charges by means of friction with the surrounding medium (in the case of automobiles) or by means of Corona discharge (in the case of aircrafts). These approaches, apart from being dangerous when used in automobiles (friction with the road may produce sparks which constitutes a fire hazard), are also ineffective because the materials used for highway construction (asphalt or cement) are excellent insulators and require a long period of time for leaking the charge to earth. In the case of aircrafts, Corona discharge is also ineffective since a considerably high potential on the body of the aircraft must be reached before the Corona effect is initiated.

Active devices for static discharge from aircrafts have been devised in the late 1960's in the United States and in other countries; however these devices lacked a suitable method of control. In practice, these active dischargers were found to have tendency to charge the body of the aircraft either positively or negatively, even if the body is completely neutral. This problem remained unsolved over the years.

When the application is considered for the human body, it is well known that static build-up on the bodies of individuals currently results in billions of dollars in damages to sensitive MOS devices each year. In addition, static represents a potential hazard to personnel who become in contact with explosive gases or materials, such as in hospitals, munition plants, etc.

Apart from corporeal and transportation-related applications, a number of systems have been devised in the art to preclude static electricity build-up. U.S. Pat. No. 3,634,726 issued Jan. 11, 1972 to Pierre Jay describes an apparatus for removing static electricity from plastic films. The apparatus requires a ground connection.

U.S. Pat. No. 4,523,252 issued Jun. 11, 1985 to J. O. Wallen describes a device for eliminating static electricity on machines and charged materials. The device depends on the operation of a tunnel diode, and must be connected between charging media and the machine part.

U.S. Pat. No. 4,766,903 issued Aug. 30, 1988 to Herbert Esper describes a device for detecting and removing static charges from the human body. The device, however, requires a ground connection.

U.S. Pat. Nos. 4,849,851 and 4,862,315 issued Jul. 18, 1989 and Aug. 29, 1989, respectively, to R. J. Cubbison, Jr. describe a static discharge device which may be contained in a wrist-mountable unit. The device uses either a high electric field or a radioactive source to ionize the air molecules. The Cubbison, Jr. patents suffer various deficiencies in use, and will not achieve their intended purpose of effectively removing charges from the body, mainly due to the following reason: it is claimed that the electric field of the body can separate the closely-spaced positive and negative ions of the air. In fact, the electric field at any particular point on the skin is negligibly small, because the charge is distributed all over the body, and is usually bound by a strong electric field to earth. For that reason, the claimed effect is very slow in nature.

Accordingly, it would be a significant advance in the art to provide a groundfree device for removing static electrical charge from the human body and from transportation vehicles, which is characterized by a high static charge removal efficiency, and which overcomes the deficiencies existent in the prior art, mainly by providing a novel mechanism for charge injection control. This is the object of the present invention.

Other applications of the present invention include the measurement of electrostatic potentials on charged bodies.

Summary of the invention

In a broad aspect, the present invention relates to a ground-free device for removing static electrical charge from conductive and semi-conductive bodies, comprising:

a capacitor comprising first and second terminals;

a conductive body contact means for establishing electrical contact with the body, and connected to the capacitor at a first terminal thereof;

a needle electrode for partial static discharge, connected to the second terminal of the capacitor;

a voltage limiting means, mounted across the capacitor;

a Voltage-Controlled Oscillator, comprising input and output terminals, with the input terminals being connected to the terminals of the capacitor;

a high-voltage generating means, comprising input and output terminals, with the input terminals being connected to the output terminals of the Voltage-Controlled Oscillator;

an air ionization mechanism, comprising first and second terminals, such terminals being connected to the output terminals of the high-voltage generating means, with the first terminal being connected to the body contact means of the device.

Other aspects and features of the invention will be more fully apparent from the ensuing disclosure and appended claims.

BRIEF DESCRIPTION OF THE DRAWINGS

FIG. 2(*b*) is an alternative schematic representation of a detailed device for the removal of charges, as employed in the present invention.

DETAILED DESCRIPTION OF THE INVENTION, AND PREFERRED EMBODIMENTS THEREOF

The present invention is based on the fundamental concept that the static charge on a conductive or semi-conductive body, such as a human body or a transportation vehicle, can be estimated by means of a discharge terminal equipped with a capacitor.

In most instances where friction occurs during bodily movements, the body is charged positively because the human body is more conductive than most other materials (clothing, upholstery, carpet, etc). A car, however, can be charged either positively or negatively, depending on the road conditions. For aircrafts, the charge is mostly negative because air precedes aluminum in the triboelectric series.

In many cases, the potential on the human body is on the order of 20 KV. For helicopters, the potential can reach 200 KV, as mentioned previously. As such bodies generally have a small capacitance with respect to earth (typically, the capacitance of the human body is 150 pF, while a helicopter hovering a few feet above the earth has a capacitance of about 1 nF), it is possible to obtain a small amount of discharge if a corona terminal is mounted on the body. If such corona terminal is further equipped with a small capacitor having a capacitance C, the discharge of static will give rise to a voltage V on the capacitor, from which the amount of discharge Q can be calculated, as $Q=CV$. The calculated amount of discharge can then be generally correlated to the total charge on the body.

Figure 1:
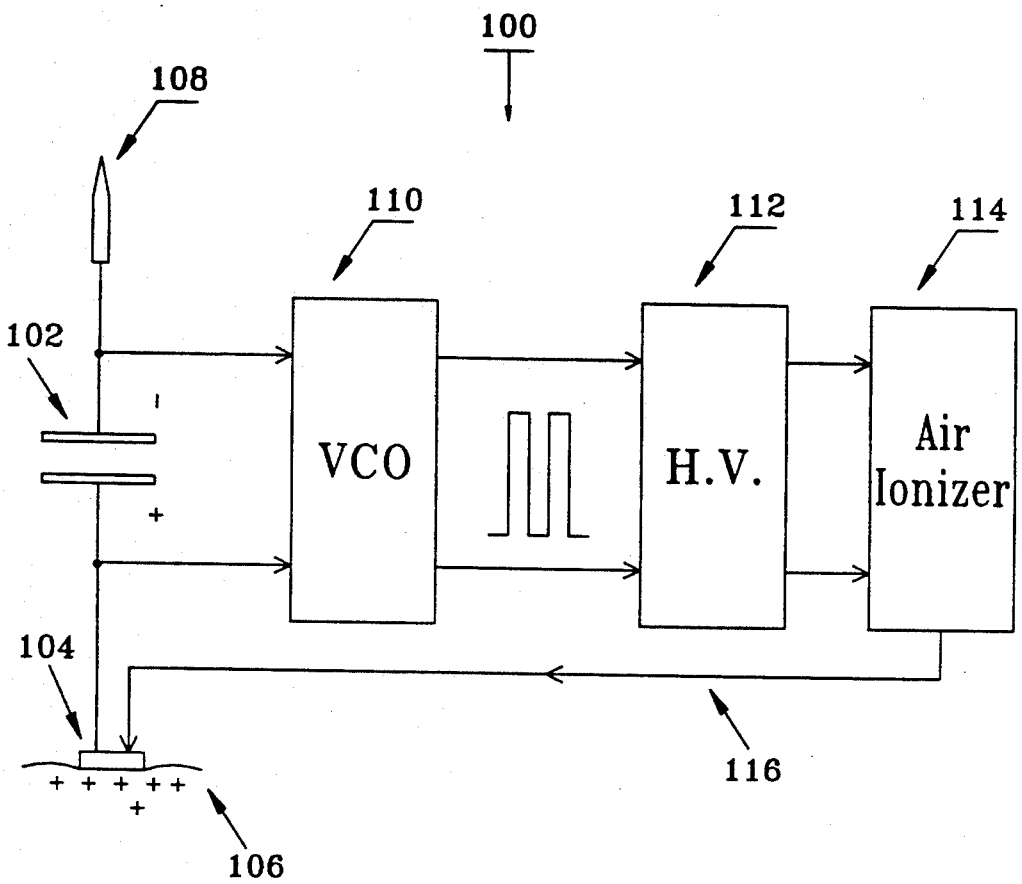
FIG. 1 is a schematic representation illustrating the basic device of the present invention, employing the principle of capacitive charge estimation for the discharge of static from a conductive or semi-conductive body.

FIG. 1 illustrates the basic device of the present invention. This figure shows a static charge removal device 100 comprising a capacitor 102 which is connected to a body contact member 104. The body contact member in turn is in contact with the body 106. The discharge terminal of the capacitor is equipped with a needle electrode 108, as shown. The voltage build-up on the capacitor is fed to a Voltage-Controlled Oscillator (VCO) 110. The output of the VCO triggers a high-voltage generating circuit 112. The high-voltage circuit, in turn, activates an air ionization mechanism 114, featuring a return path 116 for injecting charges of opposite polarity into body 106, through the body contact means of the device.

The principle of operation of the device 100 is as follows: as voltage builds up on the capacitor 102 due to partial static discharge (the capacitor 102 is suitably in the range of 0.1 nF to 0.1 $\mu$F), the VCO 110 generates pulses of a frequency that is dependent on the input voltage difference, and hence on the amount of static charge on body 106 (the VCO must preferably be capable of generating pulses of a frequency in the range of 0–1 KHz). The high-voltage circuit 112, next, multiplies the amplitude of the triggering pulses by a predetermined factor. As a result, high voltage pulses are applied to the air ionization mechanism 114, with a frequency being proportional to the amount of static charge on the body 106. The device 100, then, performs the function of ionizing the air to a degree that is proportional to the amount of charge on the body, such ionization being provided by a frequency-modulated signal.

As long as static charge remains on the body 106, partial discharge continues through the capacitor 102, and air is ionized by means of mechanism 114. As a result, opposite charges are injected into the body by means of the return path 116. Once the body 106 becomes neutralized, the capacitor 102 discharges rapidly through the internal impedance of the VCO, and the process of air ionization stops. The device 100, therefore, presents a significant advance in the art for charge-injection control.

The air ionization mechanism 114 may be any of the widely available commerical types. The simplest air ionizer is a corona wick, which requires a high voltage of at least 50 KV for proper performance. Other novel designs, like the "Supersonic Nozzle", for example, require operating voltages as low as 5 KV (the Supersonic Nozzle was invented in 1970 by B. R. Whewell in the U.K., and is fully described in an article titled A study of charged condensation droplets from an aircraft discharger, by B. R. Whewell and B. Makin, Proceedings of the third conference on static electrification, London, 1971). Other types of high-speed nozzles were developed and tested by the U.S. Navy during the late 1960's.

Figure 2A:
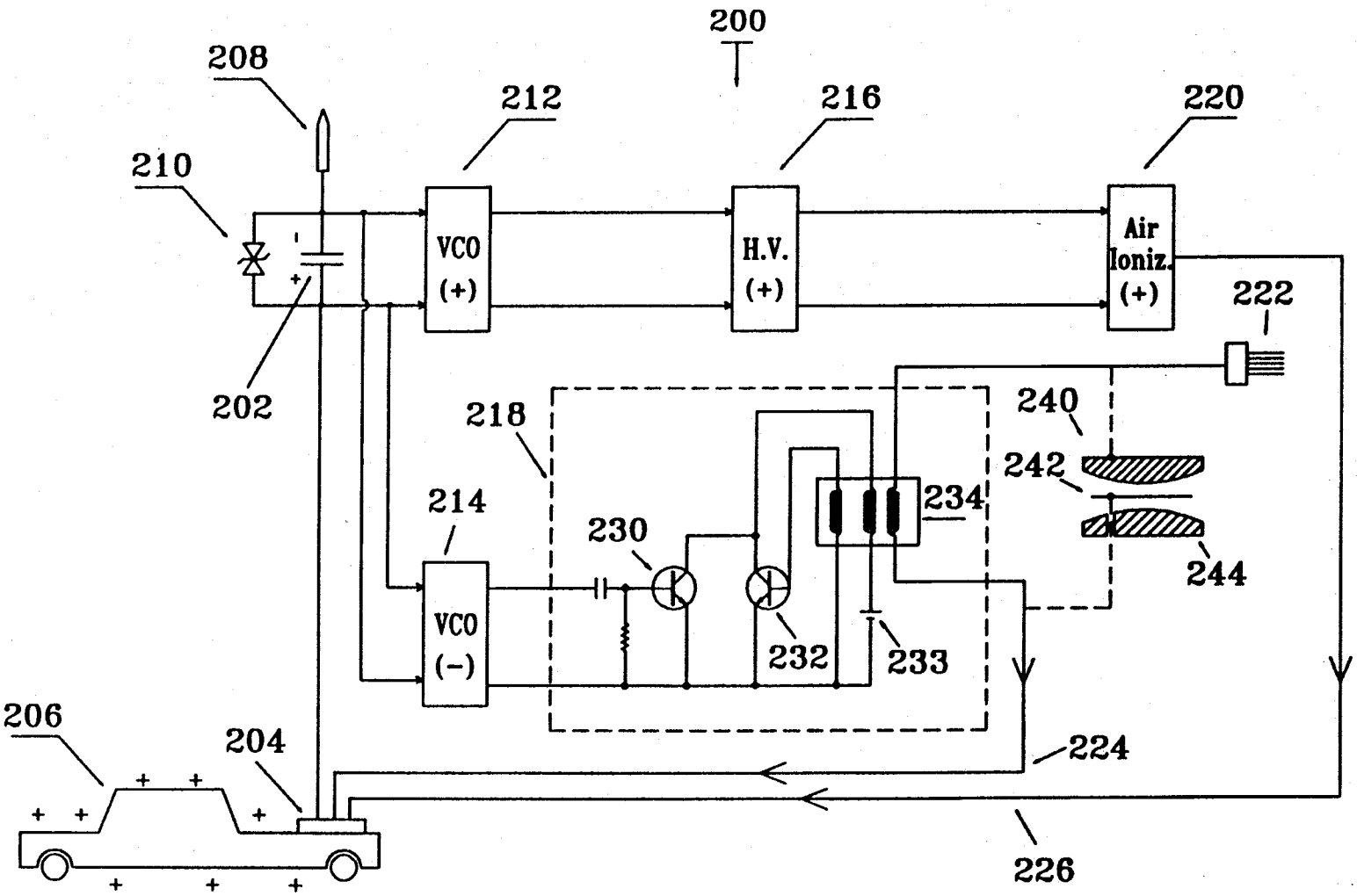
FIG. 2(*a*) is a schematic representation of a detailed device for the removal of charges, as employed in the present invention.
Figure 2B:
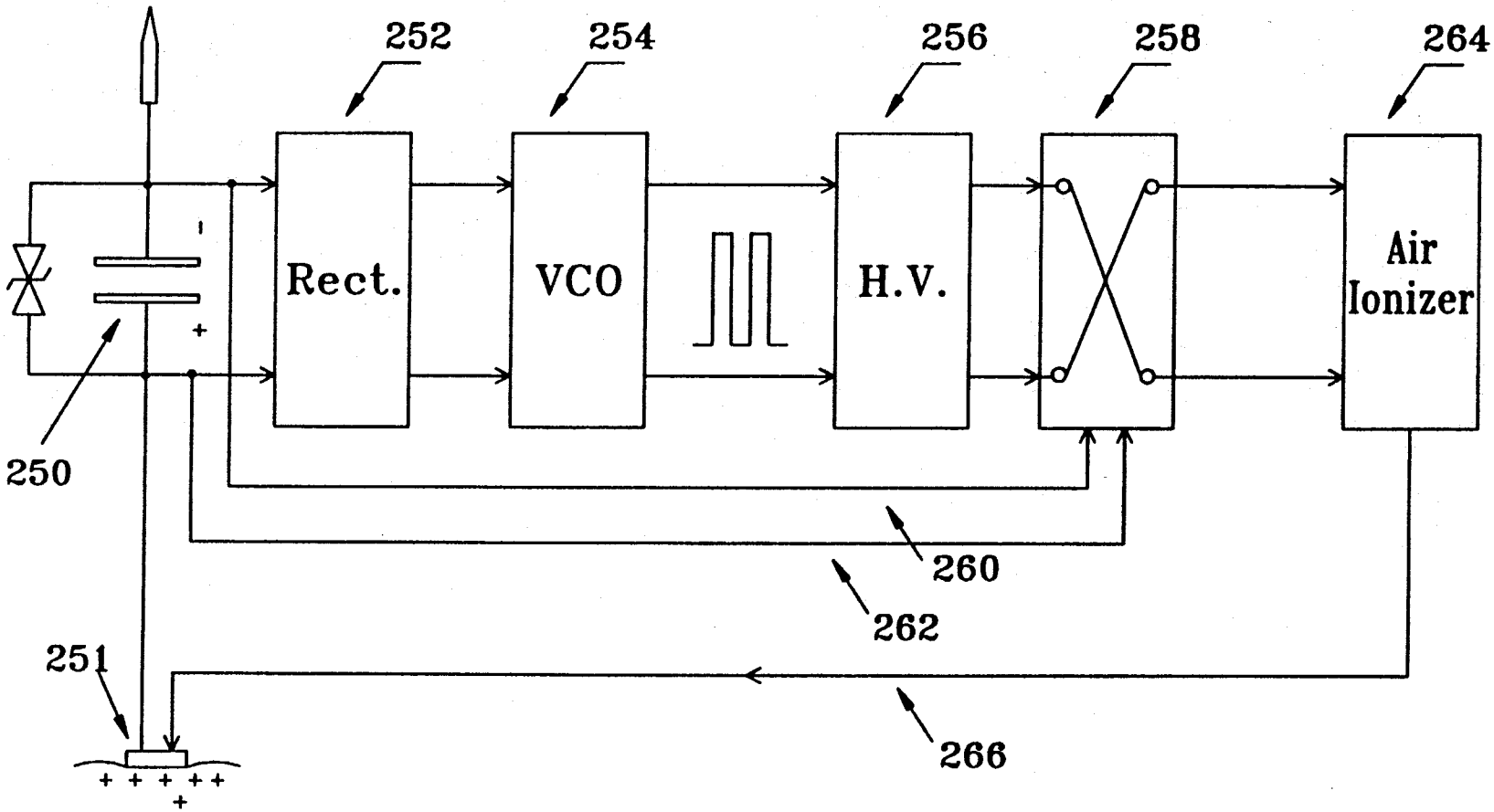

FIG. 2(*a*) shows a practical device 200 for removal of static charges from a conductive or semi-conductive body 206. Since charges on the body can be either positive or negative, the device 200 is, in fact, a duplicated version of the basic device 100 of FIG. 1.

A VCO can only respond to an input voltage of single polarity. For that purpose, two VCO's 212 and 214, one positive-activated and the other negative-activated, are mounted in parallel and fed from a capacitor 202. A voltage-limiting means 210 is further mounted across the terminals of the capacitor, which may consist of two Zener diodes mounted back-to-back.

The high-voltage circuits 216 and 218 may be of various types and configurations. As an example, FIG. 2(*a*) shows a pulse-triggered transistor blocking oscillator circuit 218, comprising transistors 230 and 232, and a pulse transformer 234 (the circuit 218 is of a known type, and is described more fully in Pulse, digital and switching waveforms, by Millman and Taub, McGraw Hill, 1984, page 605).

The air ionization mechanisms 220 and 222, as mentioned, may be any of several types available commercially. As an example, FIG. 2(*a*) shows a mechanism comprising a Corona wick 222, and featuring a return path 224 for charges of single polarity. Alternatively, a high-speed nozzle 240 comprising a needle electrode 242 and a smooth electrode 244 may be used as the ionization mechanism, where the electrodes 242 and 244 are connected to the circuit as shown by the dotted lines in FIG. 2(*a*). This type of nozzle is one of several types developed by the U.S. Navy during the 1960's.

An alternative version of the device 200 may comprise a single VCO fed from a capacitor followed by a rectifier, and a suitchable high-voltage supply to apply voltage of either positive or negative polarity to the air ionization unit.

Such an arrangement is shown in FIG. 2(*b*), where a capacitor 250 connected to a body-contact member 251, have terminals connected to a rectifying circuit 252, followed by a VCO 254, which, in turn, activates a high-voltage generating means 256. The outputs of the high-voltage supply 256 are fed to a switching circuit 258 for reversing the polarity of the output voltage, depending on the polarity of the voltage on capacitor 250, such being accomplished by means of the two terminals of the capacitor, 260 and 262, being fed to the switching circuit 258. The high voltage output then activates an air ionization mechanism 264, featuring a return path 266.

While advanced air ionizers, such as high-speed nozzles, deliver high efficiency of discharge, they generally require high speeds of airflow. For that reason, and when the application is considered for the human body, it is preferable to use a simple corona discharge point as an ionization mechanism. Corona dischargers perform well in stagnant air, however, they require elevated operating voltages.

Figure 3:
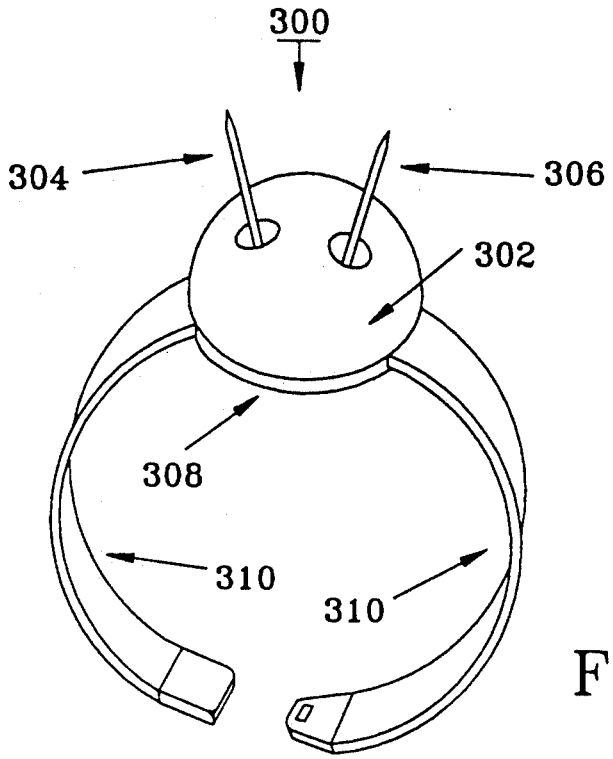
FIG. 3 is a perspective view showing a wrist-mountable static charge removal device, according to one embodiment of the invention.

FIG. 3 shows a wrist-mountable static charge removal device for the human body, constructed and arranged in accordance with FIG. 2 of the present invention. As shown in the figure, the device 300 comprises a housing 302 for the electronic components and the power source of the device. From the housing emerge two corona needles 304 and 306 for positive and negative static discharge, respectively; such needles being coupled to respective positive and negative high-voltage units, as shown in FIG. 2. Alternatively, a single needle may be used in a coupled relationship with a suitchable high-voltage supply.

The housing 302 features a body-contact terminal 308, and wrist-strap segments 310.

Figure 4:
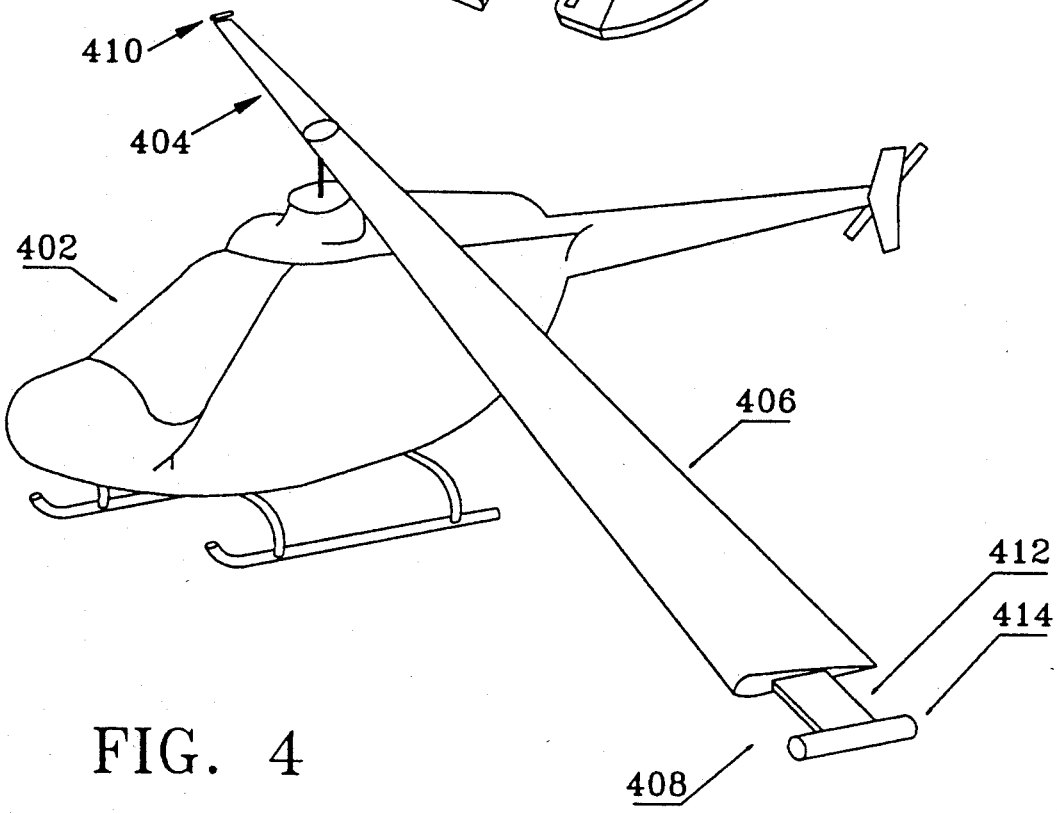
FIG. 4 is a perspective view showing a helicopter-mountable static charge removal device, according to one embodiment of the invention.

For aircraft applications, it is advantageous to make use of advanced air ionizers, such as high-speed nozzles, etc., due to the availability of high-speed airflow. When helicopter applications are considered, for instance, it should be noted that the speed of airflow is the highest at the tips of the main rotor. This location is suitable for mounting the device 100, since the device is very light in weight and very compact in form. Such an arrangement is shown in FIG. 4.

A helicopter 402 having a main rotor composed of two blades 404 and 406 carries a device for positive static discharge 408 and a device for negative static discharge 410, such devices being mounted on the rotor tips, as shown. The detailed view of the device 408 shows a housing 412 for the electronic components and the power source of the device, connected to a housing 414 for the air ionization mechanism, which may comprise a high-speed nozzle, a Corona wick, etc.

The devices 408 and 410 are constructed and arranged to be continuously supplied from an independent power source. As an example, a typical 500 mAh battery has a lifetime of one year inside such a device. However, operation from the main power source of the vehicle is possible with proper isolation techniques. In FIG. 2(*a*) the source 233 can be either an independent or the main power source.

A point of interest, when the application is considered for helicopters, is that rotor blades are usually constructed of fiberglass that is cast around a steel member. Since fiberglass is a good insulator, the device must be connected directly to the steel member. Alternatively, the rotor blades can be painted with a layer of conductive paint to establish a connection of low resistance between the device and the helicopter's body. As a still further alternative, the devices 408 and 410 can be mounted on the tail to receive a stream of air from the tail rotor, or elsewhere on the body of the helicopter to be exposed to the downwash of the main rotor.

Figure 5:
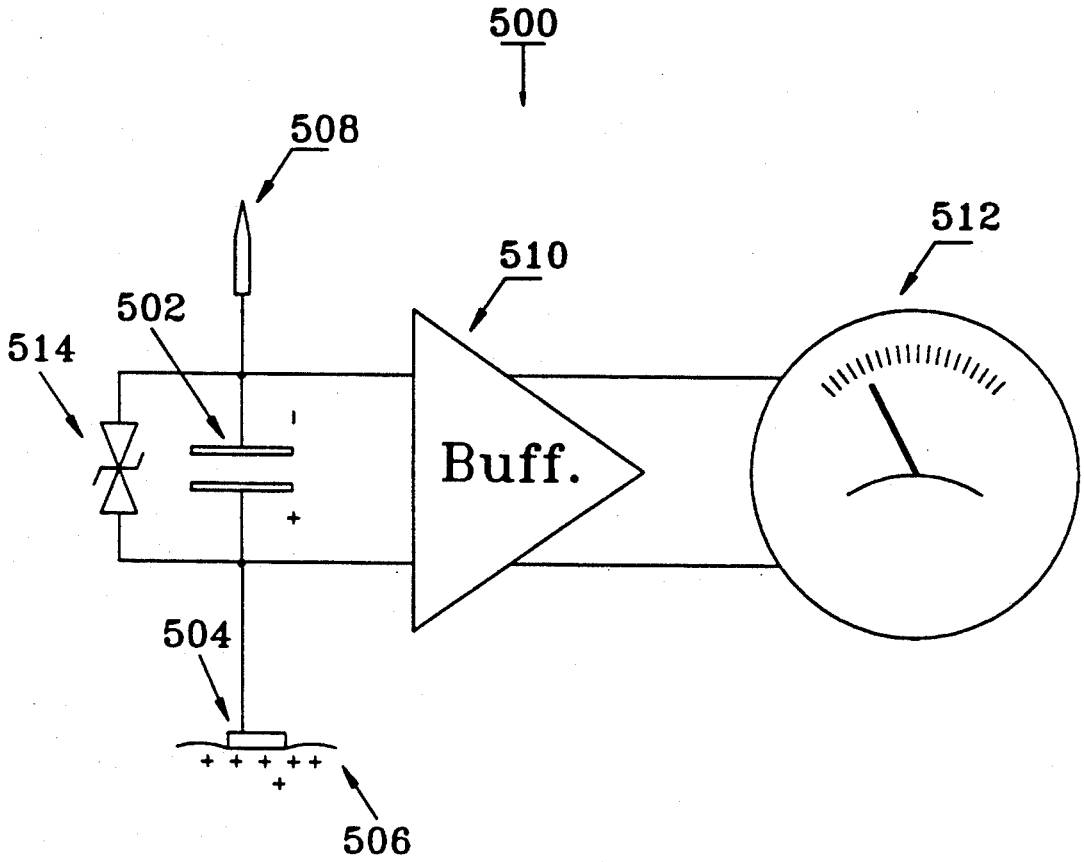
FIG. 5 is a schematic representation of a device for measurement of electrostatic potentials, employing the principle of capacitive charge estimation.

A further application of the general principle of the present invention is the estimation of electrostatic potential on a conductive or semi-conductive body. FIG. 5 shows an electrostatic voltmeter 500, comprising a discharge terminal equipped with a capacitor 502 and a needle electrode 508. The voltage build-up on the capacitor is measured by a conventional voltmeter 512, featuring high-impedance inputs by means of a buffer 510. By measuring the voltage on the capacitor, the amount of discharge Q can be calculated and correlated to the total charge on body 506 by means of a predetermined table of chart. A voltage limiting means 514, which may consist of two Zener diodes, can be further mounted across the terminals of the capacitor. Such an application provides a more accurate alternative to conventional electrostatic "field" meters.

It will be apparent from the foregoing that the static charge estimation/removal device of the present invention is a ground-free device which requires no connections or couplings to earth or other charge-dissipation structures. Further, it will be recognized that the device of the invention may be compactly configured in any of various conformations so as to be body-mountable in character. To overcome the deficiencies of prior systems, the device depends in its operation on a Voltage-Controlled Oscillator which activates the device only when static charge is detected on the body, and in a manner that is proportional to the amount of such charge, thereby providing a method of control based on frequency-modulation.

Figure 6:
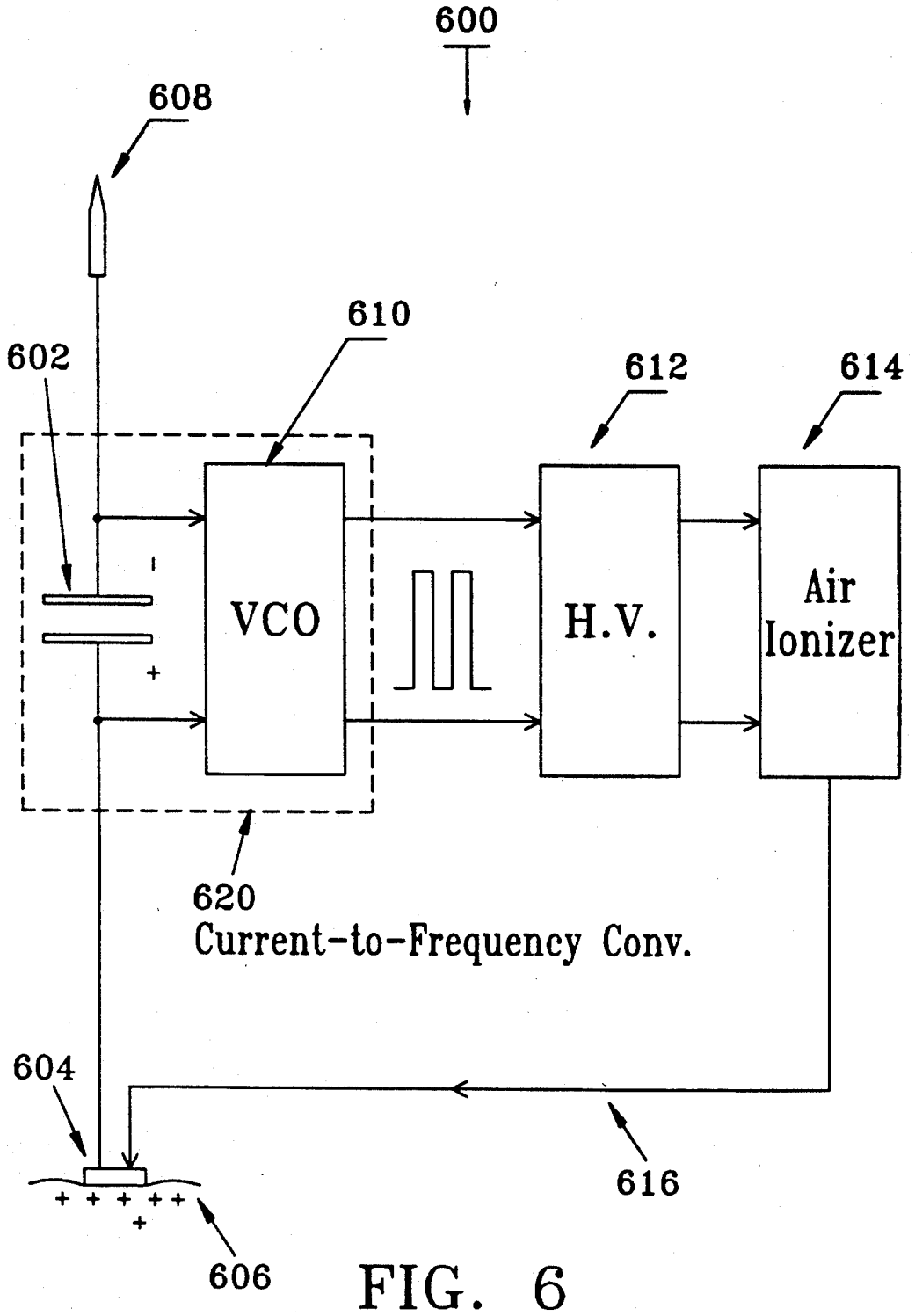
FIG. 6 is yet another alternative schematic representation of a detailed device for the removal of charges, as employed in the present invention.

While the devices of FIGS. 1, 2(*a*), 2(*b*), 3, 4 and 5 have been illustratively described hereinabove with reference to specific voltage, capacitance and frequency values, as well as specific components, it will be recognized that the device may be variously configured, utilizing other parametric values of voltage, capacitance, frequency, etc., within the skill of the art, as well as other components, as for example, a Current-to-Frequency converter may be used instead of a Voltage-to-Frequency converter, utilizing the discharge current of the capacitor. For example, FIG. 6 shows a Current-to-Frequency converter 620 comprising a capacitor 602 and a VCO 610, where the combination of capacitor and VCO consitute a suitable Current-to-Frequency converter for generating a signal of a frequency proportional to the discharge current from body 606. In plus, different types of high-voltage generating circuits can be used in the device, and different types of air ionization mechanisms may be employed without departing from the spirit and scope of the invention.

Figure 7:
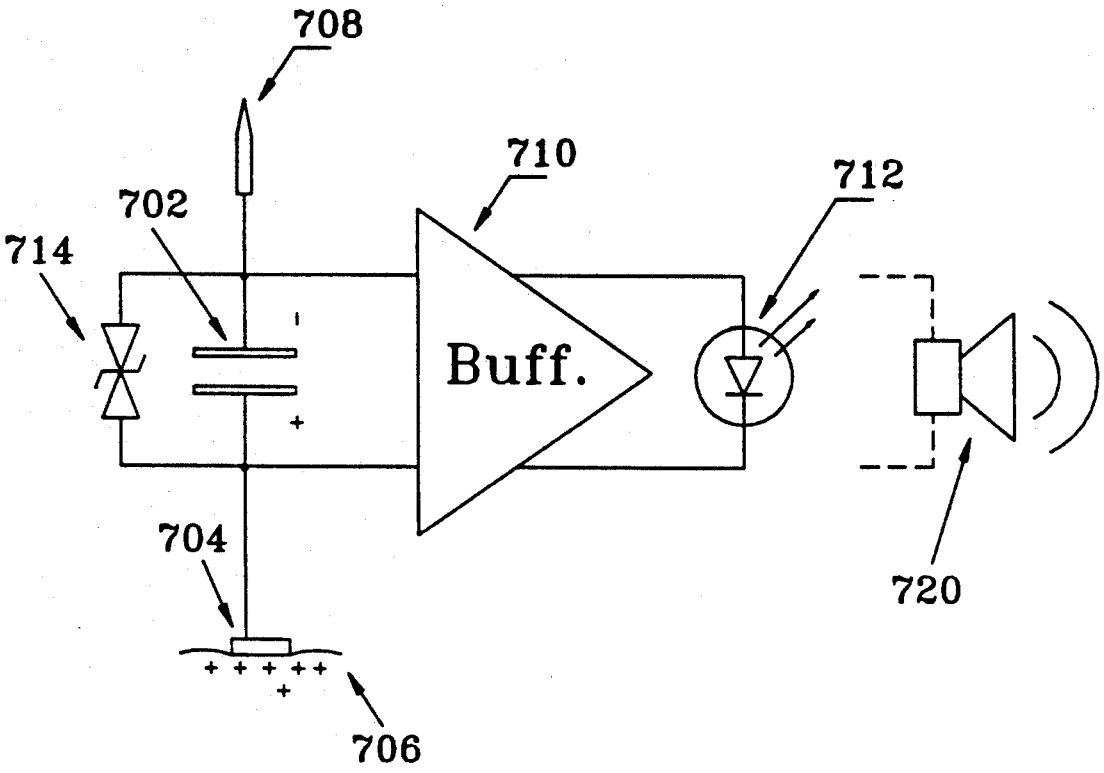
FIG. 7 is an alternative schematic representation of a device for measurement of electrostatic potential, employing the principle of capacitive charge elimination.

Further, while a high-impedance voltmeter has been shown as a voltage indication mean in the device of FIG. 5, it will be recognized that other means for indication of voltage can be used in the invention; as for example, light-emitting diodes, audible alarms, threshold circuits, etc. FIG. 7 shows the same principle of FIG. 5, with a light-emitting diode 712 being used instead of a voltmeter to indicate the presence of electrostatic charges on body 706. Alternatively, an audible alarm 720 can be used in conjunction with the same circuit.

Accordingly, while the invention has been described with reference to specific aspects, features, and embodiments, it will be appreciated that various modifications, alternatives, and other embodiments are possible within the broad scope of the invention, and the invention therefore is intended to encompass all such modifications, alternatives, and other embodiments, within its scope.

What is claimed is:

1. A ground-free device for removing static electrical charge from a conductive or semi-conductive body, comprising:

a capacitor comprising first and second terminals;

a conductive body contact means for establishing electrical contact with the body, and connected to the capacitor at a first terminal thereof;

a Voltage-Controlled Oscillator, comprising input and output terminals, with the input terminals being connected to the terminals of the capacitor;

a high-voltage generating means, comprising input and output terminals, with the input terminals being connected to the output terminals of the Voltage-Controlled Oscillator;

an air ionization mechanism, comprising first and second terminals, such terminals being connected to the output terminals of the high-voltage generating means, with the first terminal being connected to the body contact means of the device.

2. A device according to claim 1, wherein the capacitance of the capacitor in in the range of 0.1 nF to 0.1 $\mu$F.

3. A device according to claim 1, comprising voltage-limiting means mounted across the capacitor.

4. A device according to claim 3, wherein the voltage-limiting means comprises two Zener diodes.

5. A device according to claim 1, comprising a needle electrode for partial static discharge, connected to the second terminal of the capacitor.

6. A device according to claim 1, wherein the air ionization mechanism comprises a Corona wick.

7. A device according to claim 1, wherein the air ionization mechanism comprises a high-speed nozzle.

8. A device according to claim 1, wherein the Voltage-Controlled Oscillator delivers a frequency in the range of 0 to 1 KHz.

9. A device according to claim 1, wherein the high-voltage generating means comprises a transistor blocking oscillator circuit and a pulse transformer.

10. A device according to claim 1, constructed and arranged for discharging positive charges.

11. A device according to claim 1, constructed and arranged for discharging negative charges.

12. A device according to claim 1, comprising a Current-to-Frequency converter.

13. A device according to claim 1, constructed and arranged for mounting on the human body.

14. A device according to claim 1, constructed and arranged for mounting on transportation vehicles.

15. A device according to claim 14, wherein the transportation vehicle is selected from the group consisting of cars, fixed-wing aircrafts, and helicopters.

16. A device according to claim 1, powered from an independent power source.

17. A device according to claim 1, powered from the main power source.

18. A device according to claim 1, featuring a frequency-modulated signal for charge-injection control.

19. A ground-free device for removing static electrical charge from a conductive or semi-conductive body, comprising:

a capacitor comprising first and second terminals;

a conductive body contact means for establishing electrical contact with the body, and connected to the capacitor at a first terminal thereof;

a voltage rectifier comprising input and output terminals, with the input terminals being connected to the terminals of the capacitor;

a Voltage-Controlled Oscillator, comprising input and output terminals, with the input terminals being connected to the output terminals of the voltage rectifier;

a switchable high-voltage generating means, comprising input and output terminals, with the input terminals being connected to the output terminals of the Voltage-Controlled Oscillator;

an air ionization mechanism, comprising first and second terminals, such terminals being connected to the output terminals of the switchable high-voltage generating means, with the first terminal being connected to the body contact means of the device.

20. A device according to claim 19, comprising voltage-limiting means mounted across the capacitor.

21. A device according to claim 20, wherein the voltage-limiting means comprises two Zener diodes.

22. A device according to claim 19, comprising a needle electrode for partial static discharge, connected to the second terminal of the capacitor.

23. A device according to claim 19, wherein the air ionization mechanism comprises a Corona wick.

24. A device according to claim 19, wherein the air ionization mechanism comprises a high-speed nozzle.

25. A device according to claim 19, wherein the high-voltage generating means comprises a transistor blocking oscillator circuit and a pulse transformer.

26. A device according to claim 19, constructed and arranged for discharging positive charges.

27. A device according to claim 19, constructed and arranged for discharging negative charges.

28. A device according to claim 19, constructed and arranged for mounting on the human body.

29. A device according to claim 19, constructed and arranged for mounting on transportation vehicles.

30. A device according to claim 29, wherein the transportation vehicle is selected from the group consisting of cars, fixed-wing aircrafts, and helicopters.

31. A device according to claim 19, powered from an independent power source.

32. A device according to claim 19, powered from the main power source.

33. A device according to claim 19, featuring a frequency-modulated signal for charge-injection control.

* * * * *